US011135126B2

(12) United States Patent
Ma et al.

(10) Patent No.: US 11,135,126 B2
(45) Date of Patent: Oct. 5, 2021

(54) SCALP MASSAGER

(71) Applicant: SHENZHEN BREO TECHNOLOGY CO., LTD., Guangdong (CN)

(72) Inventors: Xuejun Ma, Shenzhen (CN); Yifeng Huang, Shenzhen (CN)

(73) Assignee: SHENZHEN BREO TECHNOLOGY CO., LTD, Guangdong (CN)

( * ) Notice: Subject to any disclaimer, the term of this patent is extended or adjusted under 35 U.S.C. 154(b) by 337 days.

(21) Appl. No.: 16/084,635

(22) PCT Filed: Jan. 15, 2018

(86) PCT No.: PCT/CN2018/072602

§ 371 (c)(1),
(2) Date: Sep. 13, 2018

(87) PCT Pub. No.: WO2019/095545

PCT Pub. Date: May 23, 2019

(65) Prior Publication Data

US 2020/0297573 A1 Sep. 24, 2020

(30) Foreign Application Priority Data

Nov. 16, 2017 (CN) ..... 201721535205.5

(51) Int. Cl.
*A61H 7/00* (2006.01)
*A61H 15/00* (2006.01)

(52) U.S. Cl.
CPC ..... *A61H 7/004* (2013.01); *A61H 15/0078* (2013.01); *A61H 2015/005* (2013.01); *A61H 2201/1215* (2013.01); *A61H 2201/1472* (2013.01); *A61H 2201/1657* (2013.01); *A61H 2205/021* (2013.01)

(58) Field of Classification Search
CPC ..... A61H 7/002; A61H 7/004; A61H 7/005; A61H 7/007; A61H 7/00;
(Continued)

(56) References Cited

U.S. PATENT DOCUMENTS

D46,240 S * 8/1914 Williams ..... A61H 7/004 D24/211
1,577,751 A * 3/1926 Paschall ..... A61H 7/004 601/112

(Continued)

FOREIGN PATENT DOCUMENTS

CN 103079519 A 5/2013
CN 104800063 A 7/2015

(Continued)

OTHER PUBLICATIONS

International Search Report and Written Opinion dated Aug. 16, 2018 for corresponding International Application No. PCT/CN2018/072602, filed Jan. 15, 2018.

*Primary Examiner* — Justine R Yu
*Assistant Examiner* — Kelsey E Baller
(74) *Attorney, Agent, or Firm* — Westman, Champlin & Koehler, P.A.

(57) ABSTRACT

A scalp massager, including: a housing, a motor, a transmission assembly, and a plurality of massaging head assemblies drive by the transmission assembly. The transmission assembly includes: a worm-and-gear speed reduction assembly and a plurality of driving gears driven by the worm-and-gear speed reduction assembly and horizontally arranged inside the housing. Each of the massaging head assemblies includes: a rocker, a fixing assembly, and a massaging head. The rocker passes through the fixing assembly, an upper end of the rocker is inclinedly inserted into a corresponding driving gear, an intermediate section of the rocker is provided with a ball which is rotatably arranged inside the fixing assembly, a lower end of the rocker protrudes out of the housing, and the massaging head is fixed on the lower end of the rocker.

18 Claims, 8 Drawing Sheets

(58) Field of Classification Search
CPC .... A61H 2015/0007; A61H 2015/0042; A61H 2015/0064; A61H 2015/0071; A61H 15/0078; A61H 15/0085; A61H 2201/0111; A61H 2201/0153; A61H 2201/0157; A61H 2201/12; A61H 2201/1215; A61H 2201/1463; A61H 2205/02; A61H 2205/021; A61H 2007/009; A46B 13/008; A46B 13/02; A46B 2200/102; A61C 17/26; A61C 17/34; A61C 17/3427; A61C 17/3436
USPC ..... 601/99
See application file for complete search history.

(56) References Cited

U.S. PATENT DOCUMENTS

| | | | | | |
|---|---|---|---|---|---|
| 1,709,170 | A * | 4/1929 | Hassler | A61H 7/005 | 601/103 |
| 1,710,643 | A * | 4/1929 | Hassler | A61H 7/002 | 601/133 |
| 1,931,849 | A * | 10/1933 | Matson | A61H 7/005 | 601/85 |
| 2,232,493 | A * | 2/1941 | Stuckey | A45D 19/00 | 15/22.1 |
| 2019/0192376 | A1* | 6/2019 | Xie | A61H 1/00 | |

FOREIGN PATENT DOCUMENTS

| | | | | | |
|---|---|---|---|---|---|
| CN | 204562816 | U | | 8/2015 | |
| CN | 205434294 | U | * | 8/2016 | |
| CN | 205434294 | U | | 8/2016 | |
| CN | 106618992 | A | * | 5/2017 | A61H 7/007 |
| CN | 106618992 | A | | 5/2017 | |
| JP | 3154183 | U | | 10/2009 | |
| JP | 6158716 | B2 | | 7/2017 | |
| RU | 2005112732 | A1 | | 9/2005 | |
| WO | WO-2012035931 | A | * | 3/2012 | A61H 7/007 |

* cited by examiner

SCALP MASSAGER

CROSS-REFERENCE TO RELATED APPLICATION

This Application is a Section 371 National Stage Application of International Application No. PCT/CN2018/072602, filed Jan. 15, 2018, which claims priority to Chinese Patent Application No. 201721535205.5, filed on Nov. 16, 2017, the contents of which are hereby incorporated by reference in their entirety.

TECHNICAL FIELD

The present application relates to the technical field of massager, and more particularly to a scalp massager.

BACKGROUND

Existing massagers on the market, particularly miniature massagers, such as head massagers, cannot be driven by relatively large scale motor due to the limitation by its body size. In order to reduce a motor power, an internal transmission mechanism is generally realized by a cam mechanism. However, the cam mechanism has a relatively large frictional force and a high power loss, resulting that the massaging force applied by the massaging head is generally small.

Technical Problems

It is an object of an embodiment of the present application to, on one aspect, provide a scale massager, in order to solve the technical problem that the existing scalp massage has high power loss of the internal transmission mechanism and small friction force due to the size restriction.

Technical Solutions

To solve the above technical problems, the following technical solutions are adopted by an embodiment of the present application:

On one aspect, a scalp massager is provided. The scalp massager comprises: a housing, a motor arranged inside the housing, a transmission assembly configured to be driven by the motor, and a plurality of massaging head assemblies configured to be driven by the transmission assembly and having a lower portion protruding out of the housing. The transmission assembly comprises: a worm-and-gear speed reduction assembly and a plurality of driving gears driven by the worm-and-gear speed reduction assembly and configured to drive the plurality of the massaging head assemblies respectively. The plurality of the driving gears are horizontally arranged inside the housing. Each of the massaging head assemblies comprises: a rocker, a fixing assembly, and a massaging head. The rocker extends through the fixing assembly, an upper end of the rocker is inclinedly inserted in a corresponding driving gear, an intermediate section of the rocker is provided with a ball, the ball is configured to be rotatably arranged inside the fixing assembly, a lower end of the rocker protrudes out of the housing, and the massaging head is fixed at the lower end of the rocker.

Beneficial Effects

Compared with the prior art, the scalp massager provided by embodiments of the present application has the following beneficial effect: in the present scalp massager, the worm-and-gear speed reduction assembly is driven by the motor during operation, and the four driving gears are driven by the worm-and-gear speed reduction assembly to rotate, an upper end of the rocker of each massaging head assembly is driven by the rotation of each driving gear, as the ball of the rocker is rotated inside the fixing assembly, the massing head is driven to shake. The transmission structure adopting the gear to drive the rocker effectively reduces the friction between moving parts, greatly reduces the power loss during the transmission process, such that the motor having a relatively small size can realize the massaging action with large force. Moreover, in the embodiments, the shaking of the massaging head imitates the kneading on the scalp by a human hand, thereby improving the user experience.

BRIEF DESCRIPTION OF THE DRAWINGS

In order to make the technical solution of the embodiments of the present application more clear, the drawings which would be used in description of the embodiments or the prior art are briefly introduced, it would be obvious to the persons having ordinary skills in the art that the drawings described hereinbelow are only some embodiments of the present application, and other drawings may be obtained according to these drawings without creative labors.

Figure 1:
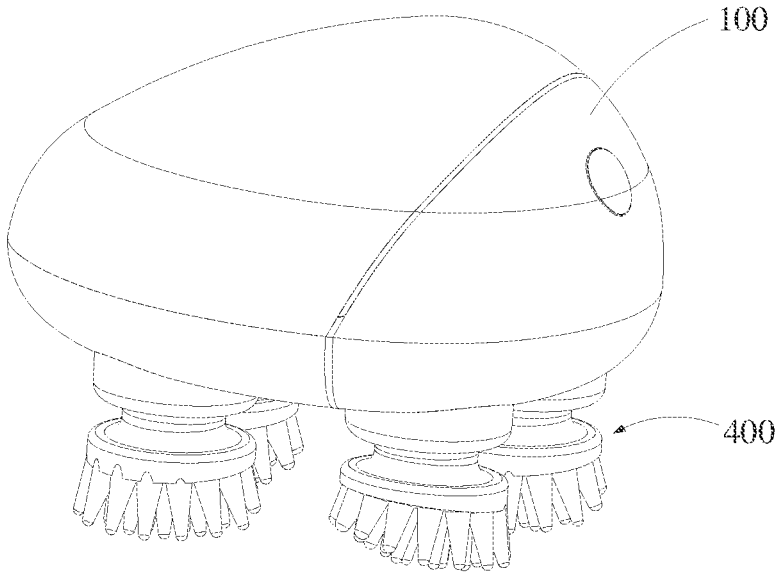
FIG. 1 is a schematic structural view of a scalp massager according to an embodiment of the present application.

In the drawings, the following reference numerals are used:

100: housing; 200: motor; 300: transmission assembly; 310: worm-and-gear speed reduction assembly; 311: worm; 312: worm gear; 313: gear set; 3131: upper gear; 3132: lower gear; 320: driving gear; 321: inclined hole; 400: massaging head assembly; 410: rocker; 411: ball; 4111: rotation stopper; 420: fixing assembly; 421: spherical recess; 422: pedestal; 4221: first through hole; 423: fixing sleeve; 4230: cylindrical portion; 4231: edge portion; 4232: second through hole; 430: massaging head; 431: mounting hole; 432: base; 433: first massaging contacts; 434: second massaging contacts; 435: third massaging contacts; 440: waterproof plastic jacket; 441: opening end; 442: closed end; 443: wrinkle; 444: mounting groove; 445: clamping block; 450:

massaging head fixing member; 451: clamping groove; 452: mounting hole; 500: battery assembly; 600: PCB; and 700: switch button.

DETAILED DESCRIPTION OF THE EMBODIMENTS

In order to make the purpose, the technical solution, and the advantages of the present application more clear, the present application will be described in further detail hereinbelow with reference to the accompanying drawings and embodiments. It should be understood that the specific embodiments described herein are merely illustrative of, but not intended to limit the present application.

It should be noted that when a component is referred to as being "fixed" or "arranged" on another component, it can be directly or indirectly on the another component. When a component is referred to as being "connected" to another component, it can be directly or indirectly connected to another component.

It should be noted that the same or similar reference numerals in the drawings of the embodiments of the present application correspond to the same or similar components. In the description of the present application, it should be understood that locative or positional relationship indicated by terms "upper", "lower", "left", "right" et al. is based on the locative or positional relationship illustrated in the drawings, which is used for facilitating the description of the present application and simplifying the description, rather than indicating or implying that the indicated device or element should have the specific location or be constructed or operated in the specific location. Therefore, the terms describing the positional relationship in the drawings are only illustrative, and should not be explained as the limitation to the present application, and specific meanings of the above terms may be understood by the persons having ordinary skills in the art according to specific circumstances.

Moreover, the terms "first" and "second" are used for descriptive purposes, but should not be construed as indication or implication of a relative importance or implicit indication of the number of technical features indicated. Thus, features defining "first" or "second" may either explicitly or implicitly include one or more of the features. In the description of the present application, unless otherwise specifically defined, the meaning of "a plurality" is two or more.

In order to explain the technical solution of the present application, the implementation of the scalp massager provided by the present application will be described in detail hereinbelow with reference to the specific drawings.

Refer to FIGS. 1-6, a scalp massager provided by an embodiment of the present application, comprises: a housing 100, a motor 200 arranged inside the housing 100, a transmission assembly 300 driven by the motor 200, and a plurality of massaging head assemblies 400 (four in this embodiment) driven by the transmission assembly 300; and the four massaging head assemblies 400 protrude out of the housing 100 from a bottom thereof. The transmission assembly 300 includes: a worm-and-gear speed reduction assembly 310 and a plurality of driving gears 320 (four in this embodiment) driven by the worm-and-gear speed reduction assembly 310. The four driving gears 320 are horizontally arranged inside the housing 100, and respectively drive the four massaging head assemblies 400. Each of the massaging head assemblies 400 includes: a rocker 410, a fixing assembly 420, and a massaging head 430. The rocker 410 passes through the fixing assembly 420. Each driving gear 320 is provided thereon with an inclined hole 321, and an upper end of the rocker 410 is inserted in the inclined hole 321. An intermediate section of the rocker 410 is provided with a ball 411 which is rotatably arranged inside the fixing assembly 420. A lower end of the rocker 410 protrudes out of the housing 100, and the massaging head 430 is fixed on the lower end of the rocker 410.

In this embodiment, the worm-and-gear speed reduction assembly 310 is driven by the motor 200 during operation, and the four driving gears 320 are driven by the worm-and-gear speed reduction assembly 310 to rotate, an upper end of the rocker 410 of each massaging head assembly 400 is driven by the rotation of each driving gear 320, as the ball 411 of the rocker 41 is rotated inside the fixing assembly 420, the massaging head 430 is driven to shake. The transmission structure which adopts the gear to drive the rocker 410 effectively reduces the friction between moving parts and greatly reduces the power loss during the transmission process, such that the motor 200 having a relatively small size can realize the massaging movement with large force. Moreover, in this embodiment, the shaking of the massaging head 430 imitates the kneading on the scalp by a human hand, thereby improving the user experience.

Figure 2:
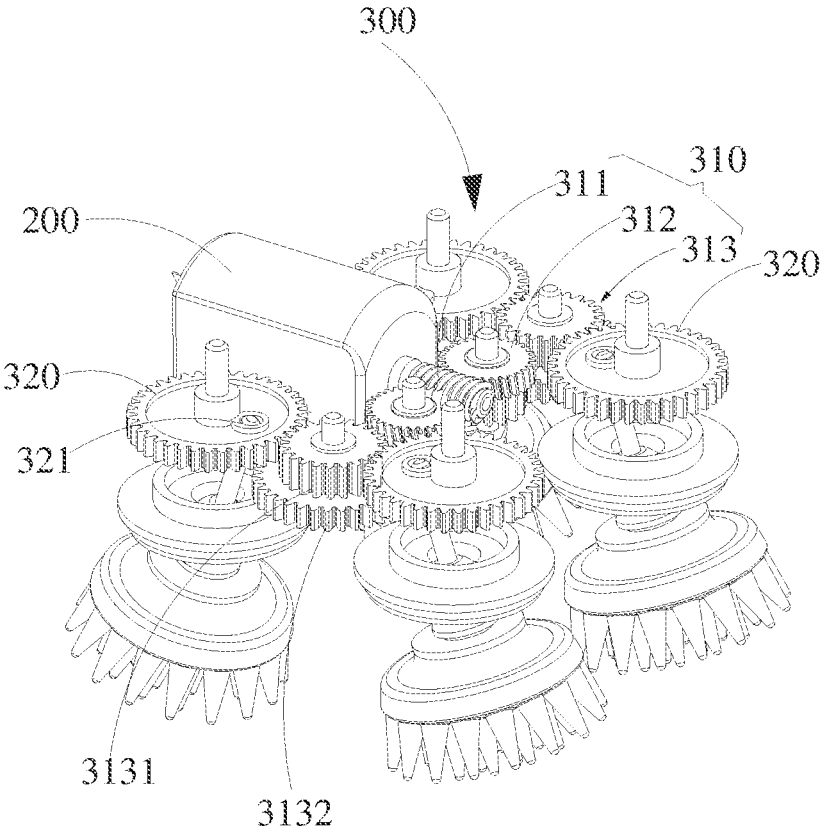
FIG. 2 is a schematic structural view of a scalp massager according to an embodiment of the present application, with a housing removed.
Figure 3:
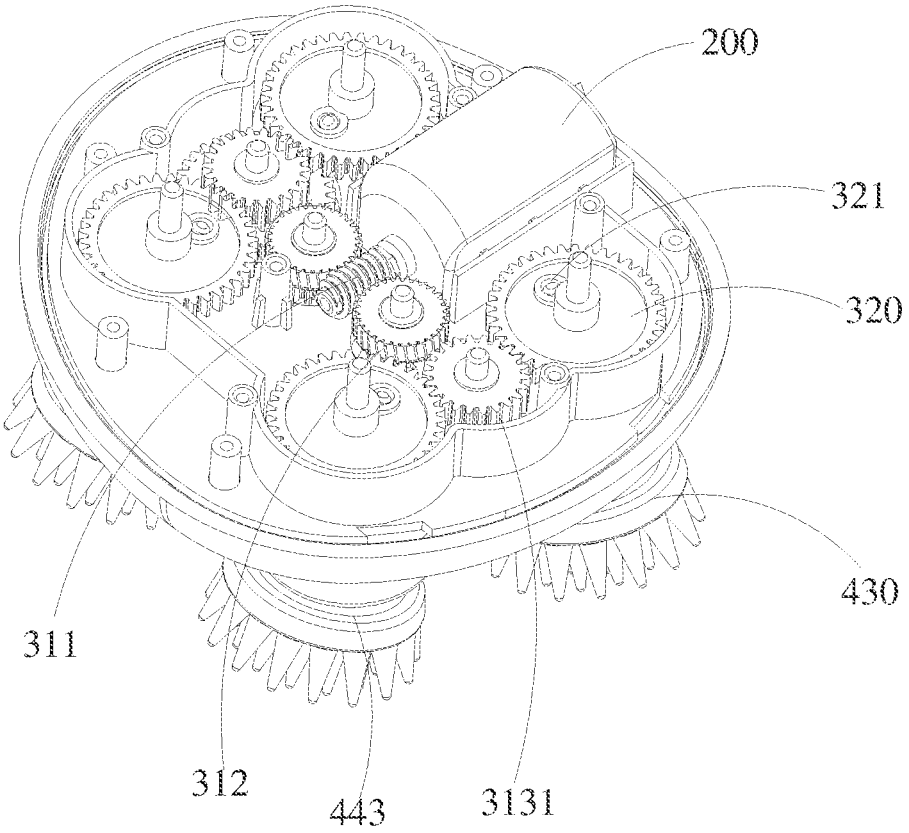
FIG. 3 is a schematic structural view of a scalp massager according to an embodiment of the present application, with an upper part of the housing removed.

As shown in FIGS. 2-3, in this embodiment, the motor 200 is horizontally arranged inside the housing 100, the worm-and-gear speed reduction assembly 310 and the four driving gears 320 are arranged on two sides of the motor 200, respectively. Such arrangement inside the housing 100 optimizes the internal structure of the housing 100, makes the thickness of the whole housing 100 much smaller and the structure of the whole product much smaller, such that the scalp massager is adapted to carry and store. Moreover, as the integral structure of the scalp massager is minimized, the appearance thereof may be designed to be a cobblestone shape, which not only enhances the artistic characteristics but also enables the user to enjoy and play in leisure times.

Figure 4:
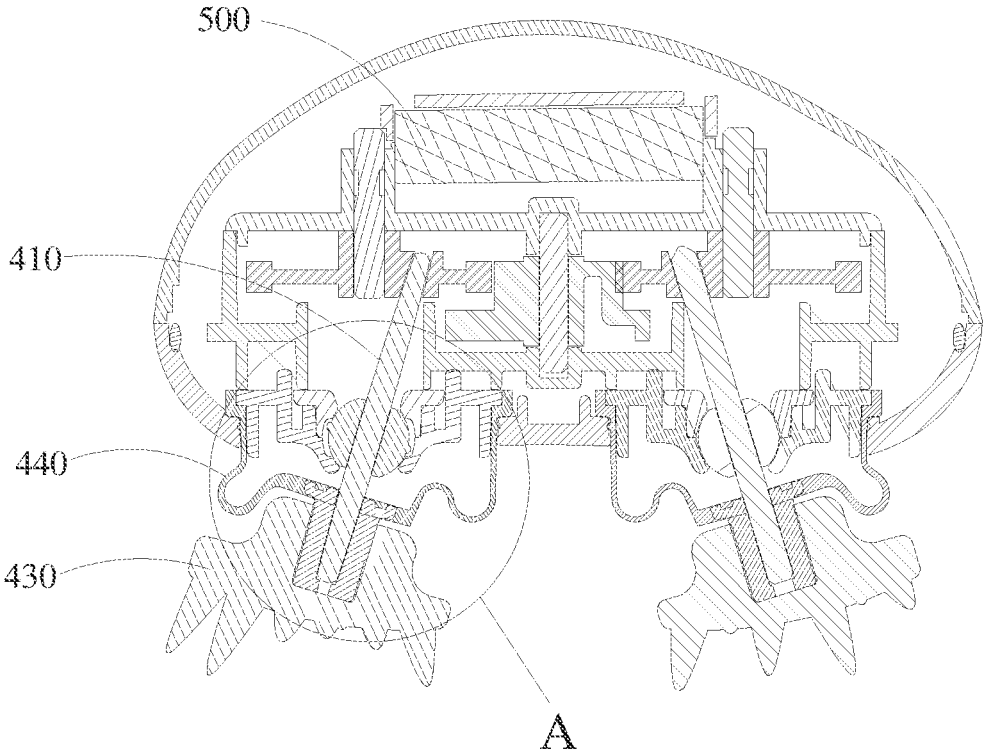
FIG. 4 is a schematic sectional view of a scalp massager according to an embodiment of the present application.
Figure 5:
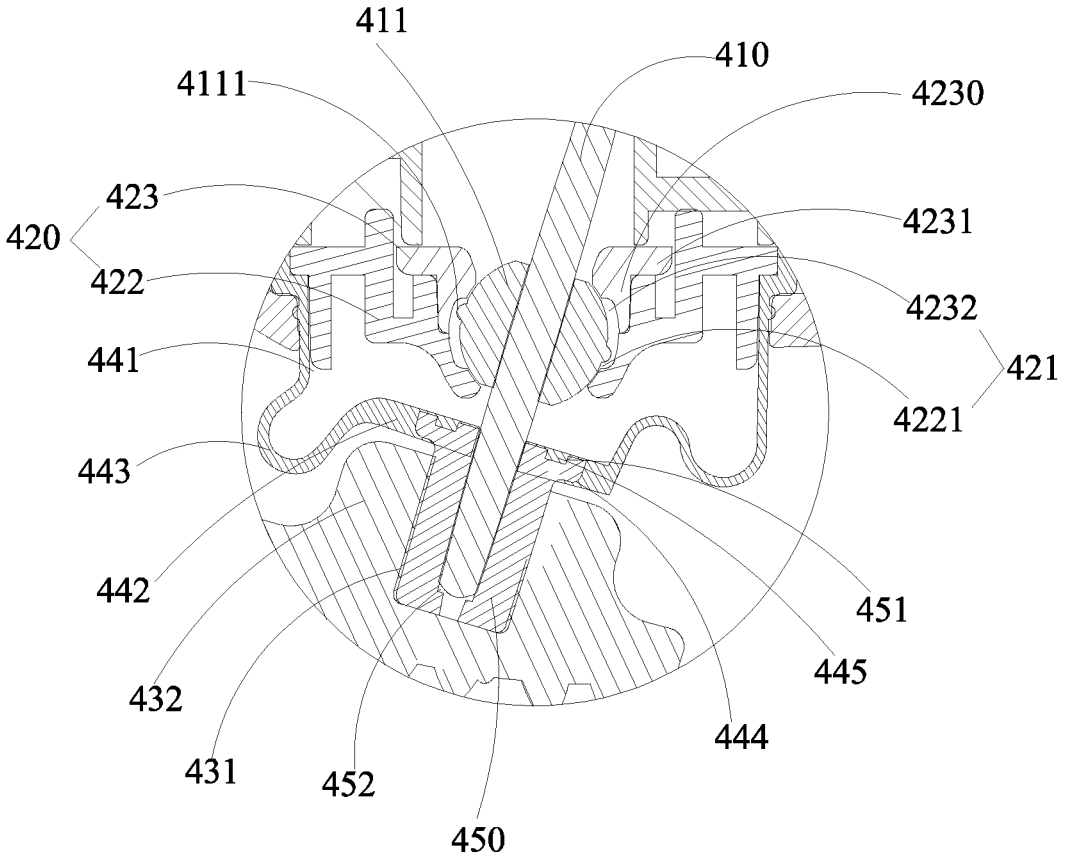
FIG. 5 is an enlarged view of part A taken from FIG. 4.
Figure 6:
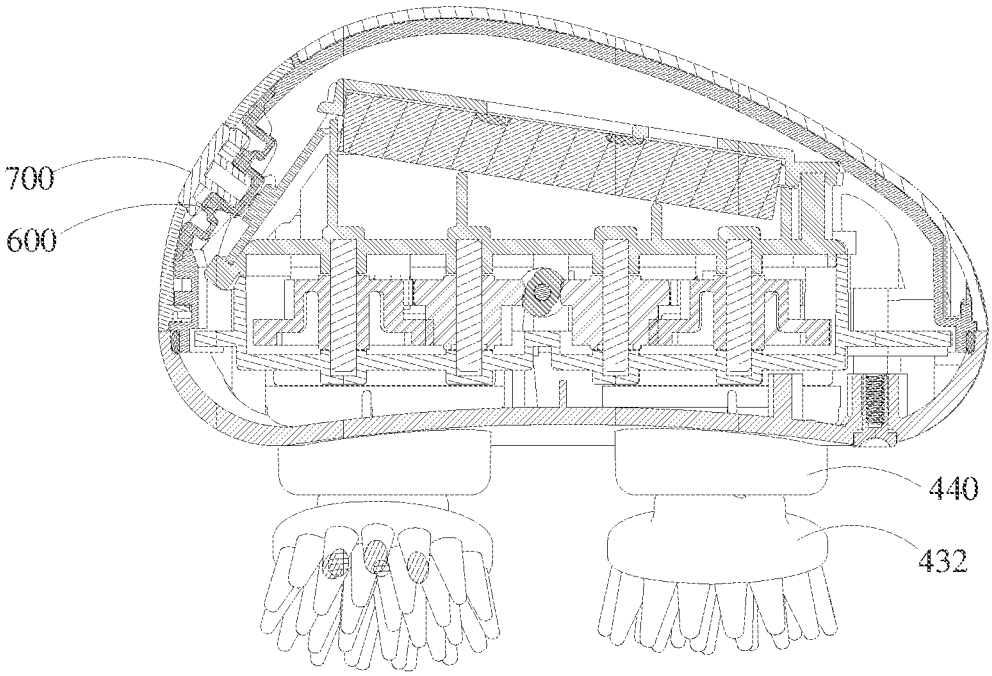
FIG. 6 is a schematic sectional view of a scalp massager from another angle according to an embodiment of the present application.
Figure 7:
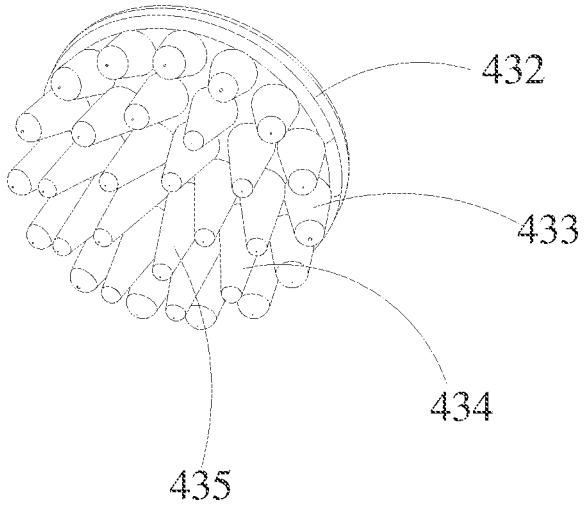
FIG. 7 is a schematic structural view of a massaging head of a scalp massager according to an embodiment of the present application.
Figure 8:
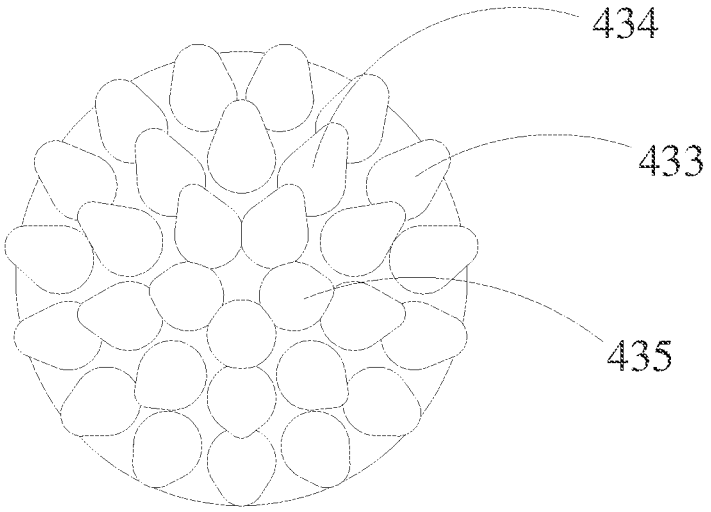
FIG. 8 is a schematic structural view of a massaging head of a scalp massager from another angle according to an embodiment of the present application.
Figure 9:
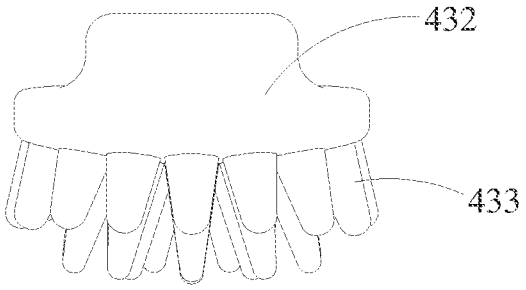
FIG. 9 is a schematic structural view of a massaging head of a scalp massager from another angle according to an embodiment of the present application.
Figure 10:
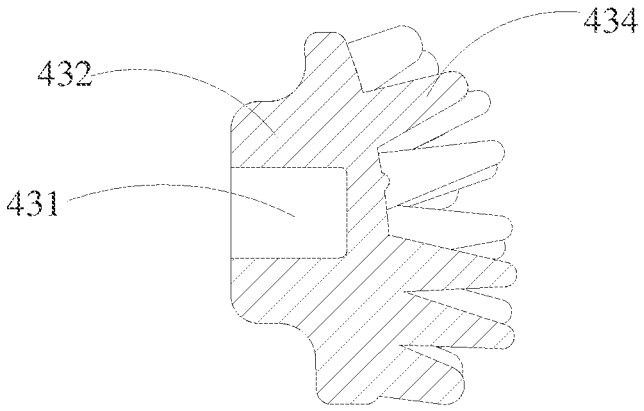
FIG. 10 is a schematic sectional view of a massaging head of a scalp massager from another angle according to an embodiment of the present application.

As shown in FIGS. 2, 4, and 5, in this embodiment, the fixing assembly 420 has a through spherical recess 421, and the ball 411 is arranged in the spherical recess 421. Specifically, the fixing assembly 420 comprises a pedestal 422 and a fixing sleeve 423 be fitted with the pedestal 422. The pedestal 422 defines therein a first through hole 4221. The fixing sleeve 423 comprises: a cylindrical portion 4230, defining therein a second through hole 4232 along a central axis of the cylindrical portion 4230; and an edge portion 4231, radially extending from one end of the cylindrical portion 4230 away from the central axis of the cylindrical portion 4230 in a direction perpendicular to the central axis. The cylindrical portion 4230 of the fixing sleeve 423 is fitted into an upper part of the first through hole 4221 such that the edge portion 4231 of the fixing sleeve 423 is supported at a region of the pedestal around a top end of the first through hole 4221. An inner surface of a lower part of the first through hole 4221 is in a spherical shape, and an inner surface of the second through hole 4232 is also in a spherical shape, and the second through hole 4232 and the lower part of the first through hole 4221 are in communication with each other and are enclosed to form the spherical recess 421 for accommodating the ball 411.

In this embodiment, a surface of the ball 411 is further provided with a rotation stopper 4111 configured for limiting the angle of the rotation. Specifically, the rotation stopper 4111 is a bump protruding from the surface of the ball 411, by arranging the bump, the friction between the ball 411 and the spherical recess 421 is improved, and the massaging head 430 is prevented from self-rotate along with the rocker 410.

As shown in FIGS. 4-5, the massaging head assembly 400 further comprises a waterproof plastic jacket 440. The waterproof plastic jacket 440 has an opening end 441 and a closed end 442. The opening end 441 is sandwiched between the fixing assembly 420 and the housing 100. The closed end 442 has a through hole, the lower end of the rocker 410 protrudes into the opening end 441 and out from the through hole. It can be known from the drawings that by wrapping by the waterproof plastic jacket 440, only the massaging head 430 is exposed out of the housing 100, such that the damage of components caused by water entering the inner of the housing 100 in use is prevented.

Further, in this embodiment, the waterproof plastic jacket 440 has a wrinkle 443. Since the waterproof plastic jacket 440 moves under the driving of the massaging head 430 during movement, the arrangement of the wrinkle 443 enables a wider moving range of the waterproof plastic jacket 440 and enables the massaging head 430 to shake freely. Moreover, the waterproof plastic jacket 440 is made of a soft plastic material with a good hand feeling, thereby avoiding the phenomenon that the hair is clamped to drag the scalp, which would occur in the event of hard plastic material.

The massaging head assembly 400 further comprises a massaging head fixing member 450. The massaging head fixing member 450 is in a structure of a cylindrical sleeve. The massaging head fixing member 450 is fixed on the lower end of the rocker 410. A top end of the massaging head fixing member 450 is in fixed connection with the waterproof plastic jacket 440, and a bottom end of the massaging head fixing member 450 is in fixed connection with the massaging head 430. The waterproof plastic jacket 440 is provided thereon with a mounting groove 444 annually arranged at the periphery of the through hole. The top end of the massaging head fixing member 450 extends into the mounting groove 444. An end face of the top end of the massaging head fixing member 450 is provided with a clamping groove 451, and the mounting groove 444 is provided therein with a clamping block 445 which can be locked inside the clamping groove 451. The massaging head fixing member 450 and the waterproof plastic jacket 440 are in sealing connection, thereby enhancing the sealing level.

The massaging head fixing member 450 has a central hole 452, the lower end of the rocker 410 is inserted in the central hole 452, an upper end face of the massaging head 430 is provided with a mounting hole 431, and the bottom end of the massaging head fixing member 450 is fixed inside the mounting hole 431.

As shown in FIG. 3, in this embodiment of the present application, the worm-and-gear speed reduction assembly 310 comprises: a worm 311 fixed at an output shaft of the motor 200, two worm gears 312 located at two sides of the worm 311 and meshing with the worm 311, and two gear sets 313 respectively meshing with the two worm gears 312. The number of the driving gears 320 is four; each gear set 313 is located between two driving gears 320. Each gear set 313 comprises an upper gear 3131 and a lower gear 3132 arranged in a coaxial manner. The lower gear 3132 meshes with the worm gear 312, and the upper gear 3131 meshes with the two driving gears 320.

In order to enhance the effect of the kneading, in this embodiment, further improvement is made on the massaging head 430. As shown in FIGS. 9-12, each massaging head 430 comprises: a base 432 located at an upper thereof, and a plurality of massaging contacts located at a bottom of the base 432. A cross section of the base 432 is circular. The massaging contacts comprise: a plurality of first massaging contacts 433 arranged in an annular pattern along an outer periphery of the circular base, a plurality of second massaging contacts 434 arranged in an annular pattern at an inner side of the plurality of the first massaging contacts 433, and a plurality of third massaging contacts 435 arranged in an annular pattern at an inner side of the plurality of the second massaging contacts 434. The plurality of the first massaging contacts 433 have the same height, the plurality of the second massaging contacts 434 have the same height, and the plurality of the third massaging contacts 435 have the same height. From the outside to the inside, the height of the massaging contacts gradually increases, that is, the height of each first massaging contact 433 is smaller than the height of each second massaging contact 434, and the height of each second massaging contact 434 is smaller than the height of each third massaging contact 435. When the base 432 is relatively large, in the same way, additional massaging contacts are further arranged at an inner side of the plurality of the third massaging contacts 435. The plurality of the first massaging contacts 433, the plurality of the second massaging contacts 434, and the plurality of the third massaging contacts 435 all adopt a shape of a truncated cone, that is, a bottom face close to the base 432 is relatively large, while the top face away from the base 432 is relatively small.

In this embodiment, based on the above design of the massaging head 430, when the massaging head 430 shakes under the driving of the rocker 410, all the plurality of the massaging contacts on the single massaging head 430 can effectively contact the scalp on the surface of the scalp, thereby ensuring an effective kneading and massaging.

In this embodiment, the housing 100 is further provided therein with a battery assembly 500, and a printed circuit board (PCB) 600 in electric connection with the battery assembly and configured to control the motor 200. And an upper surface of the housing 100 is provided with a switch control button 700.

The above are only preferred embodiments of the present application and are not intended to limit the present application. It will be apparent to persons having ordinary skills in the art that various modifications and changes can be made in the present application. Any modifications, equivalents, improvements, etc., made within the spirit and scope of the application, are intended to be included within the scope of the appended claims.

What is claimed is:

1. A scalp massager, comprising: a housing, a motor arranged inside the housing, a transmission assembly configured to be driven by the motor, and a plurality of massaging head assemblies configured to be driven by the transmission assembly and having a lower portion protruding out of the housing;

wherein the transmission assembly comprises: a worm-and-gear speed reduction assembly, and a plurality of driving gears driven by the worm-and-gear speed reduction assembly and configured to drive the plurality of the massaging head assemblies respectively;

the plurality of the driving gears are horizontally arranged inside the housing;

each of the massaging head assemblies comprises: a rocker, a fixing assembly, and a massaging head;

the rocker extends through the fixing assembly, an upper end of the rocker is inclinedly inserted in a corresponding driving gear, an intermediate section of the rocker is provided with a ball, the ball is configured to be rotatably arranged inside the fixing assembly, a lower end of the rocker protrudes out of the housing, and the massaging head is fixed at the lower end of the rocker;

the fixing assembly has a through spherical recess, and the ball is arranged in the spherical recess;

the fixing assembly comprises: a pedestal having a first through hole, and a fixing sleeve;

the fixing sleeve comprises: a cylindrical portion, defining therein a second through hole along a central axis of the cylindrical portion; and an edge portion, radially extending from one end of the cylindrical portion away from the central axis of the cylindrical portion in a direction perpendicular to the central axis;

the cylindrical portion of the fixing sleeve is fitted into an upper part of the first through hole such that the edge portion of the fixing sleeve is supported at a region of the pedestal around a top end of the first through hole;

and the second through hole and a lower part of the first through hole are in communication with each other and are enclosed to form the spherical recess for accommodating the ball.

2. The scalp massager of claim 1, wherein a surface of the ball is provided with a rotation stopper for limiting an angle of rotation.

3. The scalp massager of claim 1, wherein the massaging head assembly further comprises a waterproof plastic jacket; the waterproof plastic jacket has an opening end and an end opposite to the opening end; the opening end is sandwiched between the fixing assembly and the housing; and the end opposite to the opening end has a through hole, and the lower end of the rocker protrudes out of the through hole.

4. The scalp massager of claim 3, wherein the massaging head assembly further comprises a massaging head fixing member; the massaging head fixing member is fixed at the lower end of the rocker; a top end of the massaging head fixing member is in fixed connection with the waterproof plastic jacket; and a bottom end of the massaging head fixing member is in fixed connection with the massaging head.

5. The scalp massager of claim 4, wherein the waterproof plastic jacket is provided thereon with a mounting groove annually arranged at the periphery of the through hole; the top end of the massaging head fixing member extends into the mounting groove; an end face of the top end of the massaging head fixing member is provided with a clamping groove, and the mounting groove is provided therein with a clamping block which is configured to be locked inside the clamping groove.

6. The scalp massager of claim 3, wherein a massaging head fixing member has a central hole, the lower end of the rocker is inserted into the central hole, an upper end face of the massaging head is provided with a mounting hole, and a bottom end of the massaging head fixing member is fixed inside the mounting hole.

7. The scalp massager of claim 1, wherein the worm-and-gear speed reduction assembly comprises: a worm fixed at an output shaft of the motor, two worm gears located respectively at two sides of the worm and meshing with the worm, and two gear sets respectively meshing with the two worm gears.

8. The scalp massager of claim 7, wherein the number of the driving gears is four; each gear set is located between two driving gears; each gear set comprises an upper gear and a lower gear arranged in a coaxial manner; and the lower gear meshes with the worm gear, and the upper gear meshes with the two driving gears.

9. The scalp massager of claim 1, wherein each massaging head comprises: a base located at an upper thereof, and a plurality of massaging contacts located at a bottom of the base; a cross section of the base is circular; the plurality of massaging contacts comprise: a plurality of first massaging contacts arranged in an annular pattern along an outer periphery of the circular base, a plurality of second massaging contacts arranged in an annular pattern at an inner side of the plurality of the first massaging contacts, and a plurality of third massaging contacts arranged in an annular pattern at an inner side of the plurality of the second massaging contacts.

10. The scalp massager of claim 9, wherein the plurality of the first massaging contacts have the same height, the plurality of the second massaging contacts have the same height, and the plurality of the third massaging contacts have the same height.

11. The scalp massager of claim 10, wherein the height of each said first massaging contact is smaller than the height of each said second massaging contact, and the height of each said second massaging contact is smaller than the height of each said third massaging contact.

12. The scalp massager of claim 9, wherein the plurality of the first massaging contacts, the plurality of the second massaging contacts, and the plurality of the third massaging contacts all present a shape of a truncated cone.

13. The scalp massager of claim 4, wherein the massaging head fixing member has a central hole, the lower end of the rocker is inserted into the central hole, an upper end face of the massaging head is provided with a mounting hole, and the bottom end of the massaging head fixing member is fixed inside the mounting hole.

14. The scalp massager of claim 2, wherein the rotation stopper is a bump protruding from the surface of the ball.

15. The scalp massager of claim 3, wherein the waterproof plastic jacket has a wrinkle.

16. The scalp massager of claim 3, wherein the waterproof plastic jacket is made of a soft plastic material.

17. The scalp massager of claim 1, wherein the housing is further provided therein with a battery assembly, and a printed circuit board in electric connection with the battery assembly and configured to control the motor; and an upper surface of the housing is provided with a switch control button.

18. The scalp massager of claim 1, wherein the motor is horizontally arranged inside the housing.

* * * * *